US005755643A

United States Patent [19]

Sands et al.

[11] Patent Number: 5,755,643

[45] Date of Patent: May 26, 1998

[54] FOLDING COLLAPSIBLE STEP EXERCISER WITH DAMPING MEANS

[76] Inventors: Lenny Sands, 4555 Reseda Blvd., Tarzana, Calif. 91356; Johnson Kuo, 5F., No. 6, Lane 12, Sec. 6, Hsin I Rd., Taipei, Taiwan

[21] Appl. No.: 886,937

[22] Filed: Jul. 2, 1997

[51] Int. Cl.[6] ..... A63B 69/16; A63B 22/04

[52] U.S. Cl. ..... 482/57; 482/51

[58] Field of Search ..... 482/51, 52, 53, 482/57, 70, 71, 79, 80, 54, 62

[56] References Cited

U.S. PATENT DOCUMENTS 5,102,380 4/1992 Jacobson et al. ..... 482/54
5,529,555 6/1996 Rodgers ..... 482/51
5,577,985 11/1996 Miller ..... 482/52
5,685,804 11/1997 Whan-Tong et al. ..... 482/57
5,692,994 12/1997 Eschenbach ..... 482/57

*Primary Examiner*—Stephen R. Crow
*Attorney, Agent, or Firm*—Varndell Legal Group

[57] ABSTRACT

A folding collapsible step exerciser including a base frame, a front upright pivoted to a front side of the base frame and locked in a vertical position by a lock screw, a driving wheel revolvably supported on the base frame and having a double crank type wheel shaft, a damping wheel turned with the driving wheel, a friction belt mounted on the base frame and adapted to impart a friction resistance to the damping wheel, two handlebars bilaterally pivoted to the front upright, and two pedals having a respective front end respectively pivoted to the bottom ends of the handlebars and a respective rear end respectively pivoted to the two ends of the double crank type wheel shaft of the driving wheel.

1 Claim, 6 Drawing Sheets

FOLDING COLLAPSIBLE STEP EXERCISER WITH DAMPING MEANS

BACKGROUND AND SUMMARY OF THE INVENTION

The present invention relates to step exercising machines, and more particularly to a folding collapsible step exerciser which can be unlocked and folded up into a collapsed condition when not in use.

A variety of exercising machines such as step exercisers, jogging exercisers, sliding exercisers, etc., have been disclosed, and have appeared on the market. Exemplars of these exercising machines are seen in U.S. Pat. Nos. 4,850,585; 358,436; 5,423,729 5,383,829. The exercising machines disclosed in U.S. Pat. No. 4,850,585 and U.S. Pat. No. 358,436 are designed for exercising the muscles of the legs only, and the handlebars are not linked to the pedals for exercising the muscles of the hands. The exercising machines disclosed in U.S. Pat. No. 5,423,729 and U.S. Pat. No. 5,383,829 enable the user to exercise the muscles of the hands when exercising the legs, however these exercising machines produce less exercising effect to the legs because the legs are simply oscillating in a smoothly curved path.

It is one object of the present invention to provide a step exerciser which enables the user to simultaneously exercise the hands and the legs. It is another object of the present invention to provide a step exerciser which can be folded up into a collapsed condition to minimize its space occupation when not in use. It is still another object of the present invention to provide a step exerciser which is practical for football players to make exercises. According to one embodiment of the present invention, the folidng collapsible step exerciser comprises a base frame, a front upright pivoted to a front side of the base frame and locked in a vertical position by a lock screw, a driving wheel revolvably supported on the base frame and having a double crank type wheel shaft, a damping wheel turned with the driving wheel, a friction belt mounted on the base frame and adapted to impart a friction resistance to the damping wheel, two handlebars bilaterally pivoted to the front upright, and two pedals having a respective front end respectively pivoted to the bottom ends of the handlebars and a respective rear end respectively pivoted to the two ends of the double crank type wheel shaft of the driving wheel. When a football player uses the step exerciser, the player can bent the body with the hands grasped on the lower ends of the handlebars, and then push and Pull the handlebars with the hands when stepping the pedals with the legs.

DETAILED DESCRIPTION OF THE PREFERRED EMBODIMENT

Figure 1:
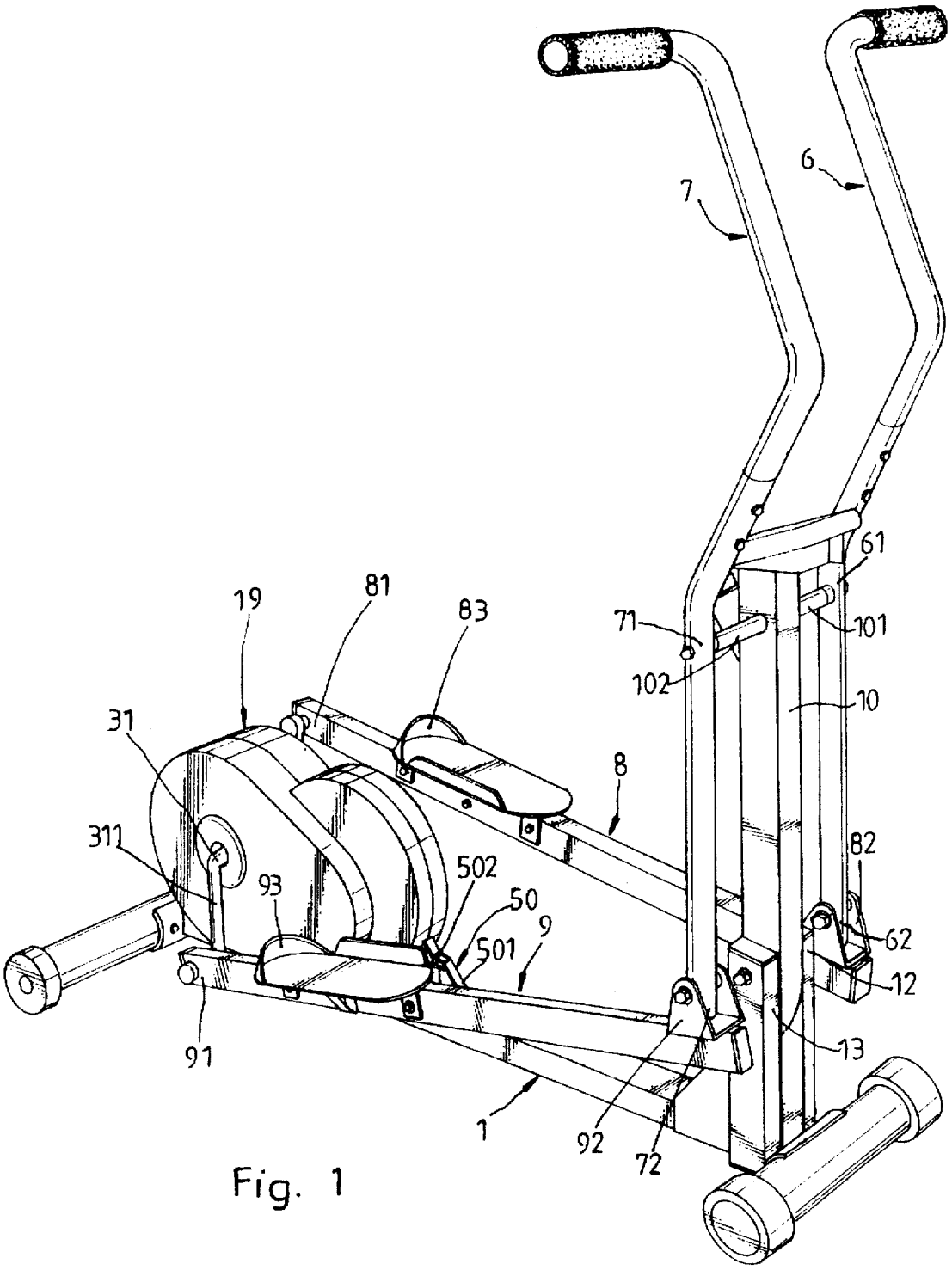
FIG. 1 is a perspective elevational view of a foldidng collapsible step exerciser according to the present invention.

Referring to FIGS. from 1 to 6, a folding collapsible step exerciser in accordance with the present invention is generally comprised of a base frame 1, a front upright 10, a substantially U-shaped damping wheel holder frame 2, an idle wheel 301, a transmission belt 40, a damping wheel 5, a damping device 50, a driving wheel 3, a left handlebar 6 and a right handlebar 7, a left pedal 8 and a right pedal 9.

The base frame 1 comprises a front mounting block 11, two front supports 12; 13 bilaterally and fixedly fastened to the front mounting block 11, a rear support 15, and an axle housing 151 transversely and fixedly mounted on the rear support 15 at its top.

The front upright 10 is pivotably connected between the front supports 12;13 of the base frame 1, having a bottom end releasably secured to the front mounting block 11 of the base frame 1 by a lock screw 16 and a top end fixedly mounted with two horizontally aligned pivots 101;102.

Figure 3:
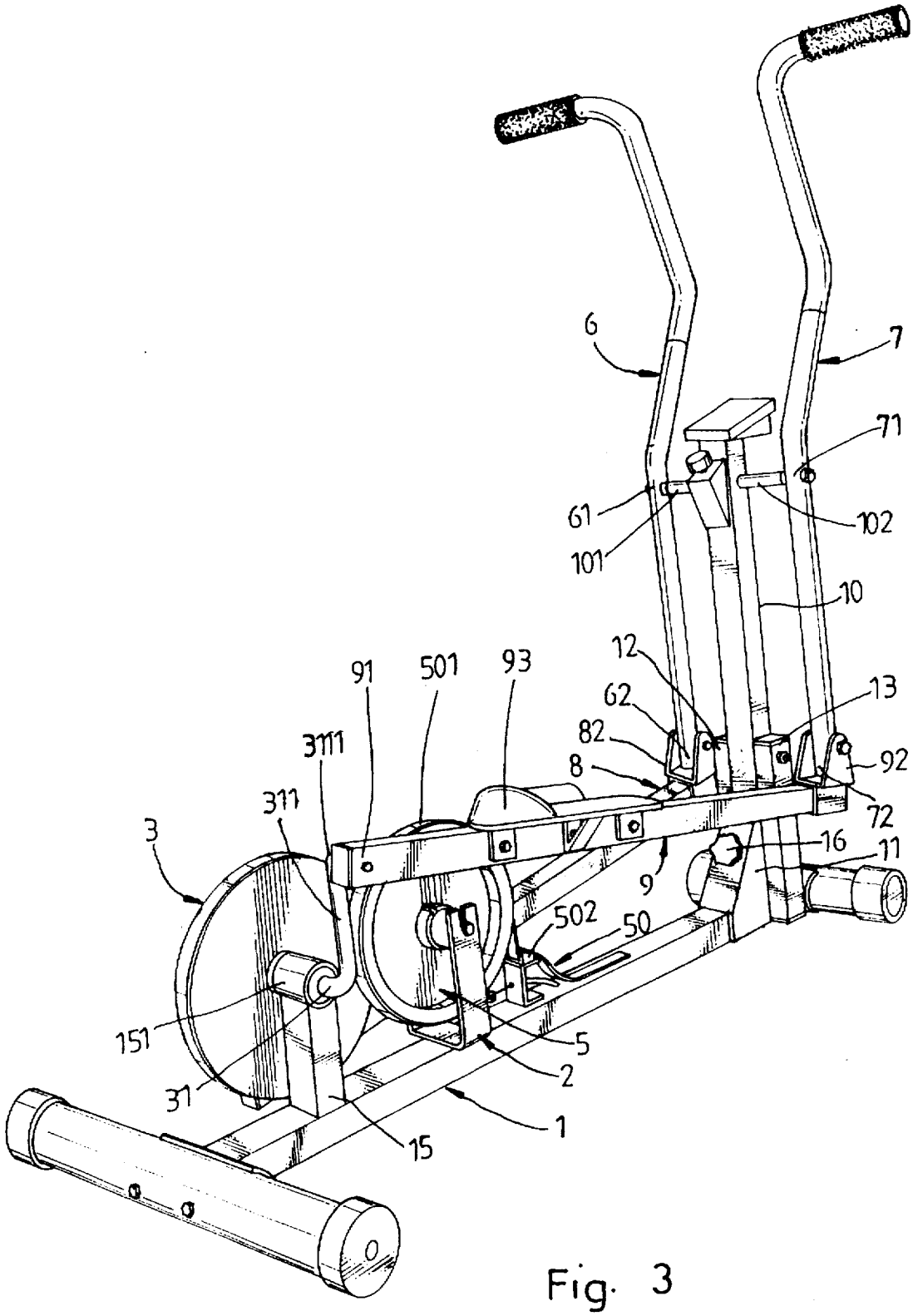
FIG. 3 is another perspective elevational view of the folding collapsible step exerciser, showing the guard frame removed.
Figure 4:
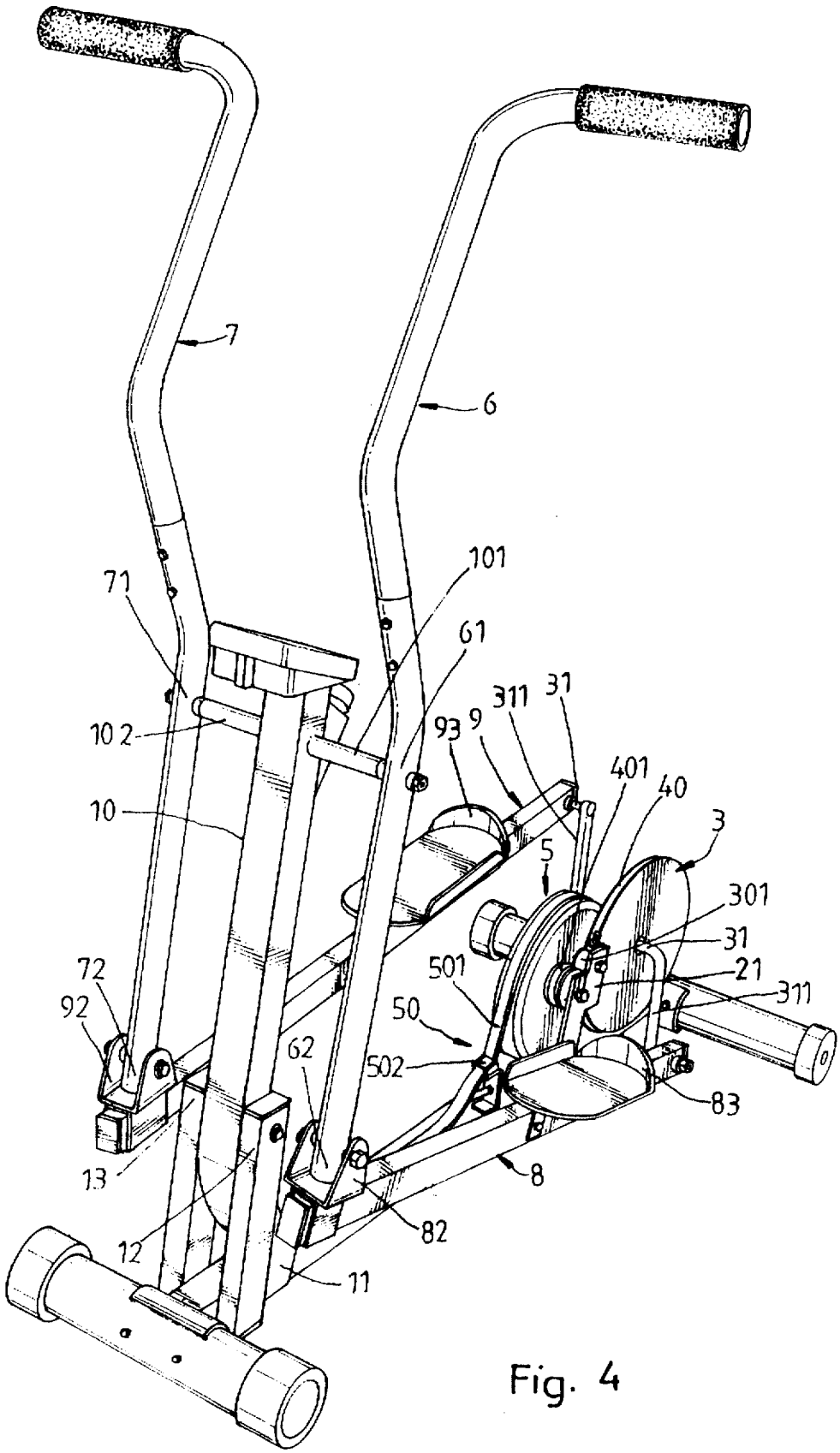
FIG. 4 is another perspective elevational view of the folding collapsible step exerciser showing the guard frame removed when viewed from another angle.

The U-shaped damping wheel holder frame 2 is fixedly mounted on the base frame 1 between the front supports 12;13 and the rear support 15, ahving two upright arms 21 adapted to support the damping wheel 5 and the idle wheel 301 (see FIGS. 3 and 4).

The idle wheel 301 is pivoted to one arm 21 of the U-shaped damping wheel holder frame 2, and adapted to impart a pressure to the transmission belt 40.

The damping wheel 5 is revolvably supported on the upright arms 21 of the U-sahped damping wheel holder frame 2, having a coupling portion 401 at one side coupled to the driving wheel 3 by the transmission belt 40 (see FIG. 4).

The damping device 50 comprising a friction belt 501 mounted on the base frame 1 over the periphery of the damping wheel 5 and imparting a friction resistance to the damping wheel 5, and an adjustment device 502 controlled to adjust the tension of the friction belt 501.

The driving wheel 3 is revolvably supported on the axle housing 151 of the base frame 1, having a fixed wheel shaft 31 made in the form of a double crank with its two L-shaped ends 311 respectively pivoted to the pedals 8;9.

The pedals 8;9 have a respective rear end 81; 91 respectively pivoted to the tail pieces 3111 of the two L-sahped ends 311 of the fixed wheel shaft 31, and a respective front end fixedly mounted with a respective U-frame 82;92 adapted for coupling to the handlebars 6;7. Further, two foot plates 83;93 are respectively mounted on the pedals 8;9 at the top adjacent their rear ends 81;91.

The handlebars 6;7 have a respective middle part 61;71 respectivel pivoted to the pivots 101;102 of the front upright 10, and a respective bottom end 62;72 repsectively pivoted to the U-frames 82;92 of the pedals 8;9.

Figure 5:
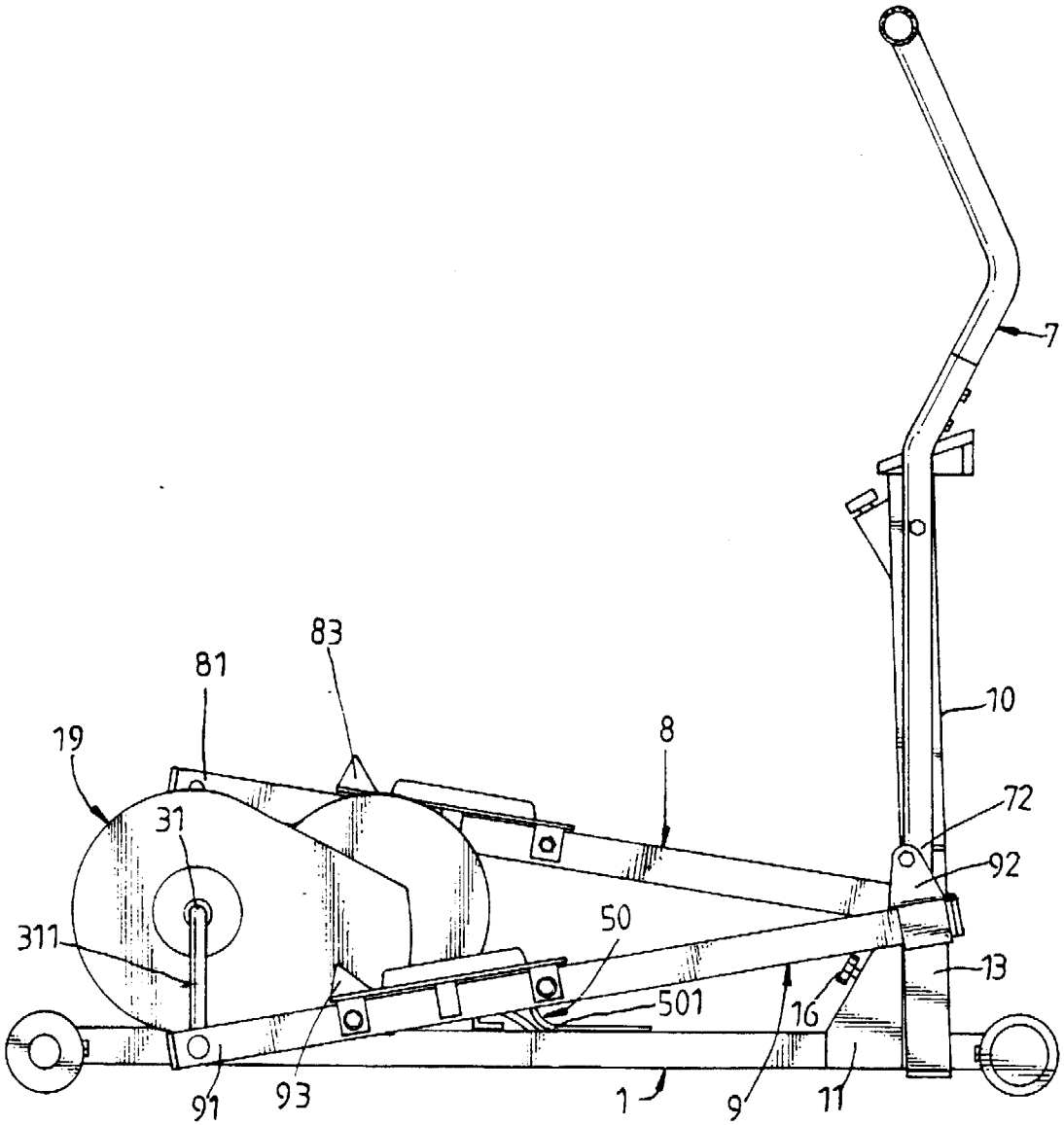
FIG. 5 is a side view of the folding collapsible step exerciser.
Figure 6:
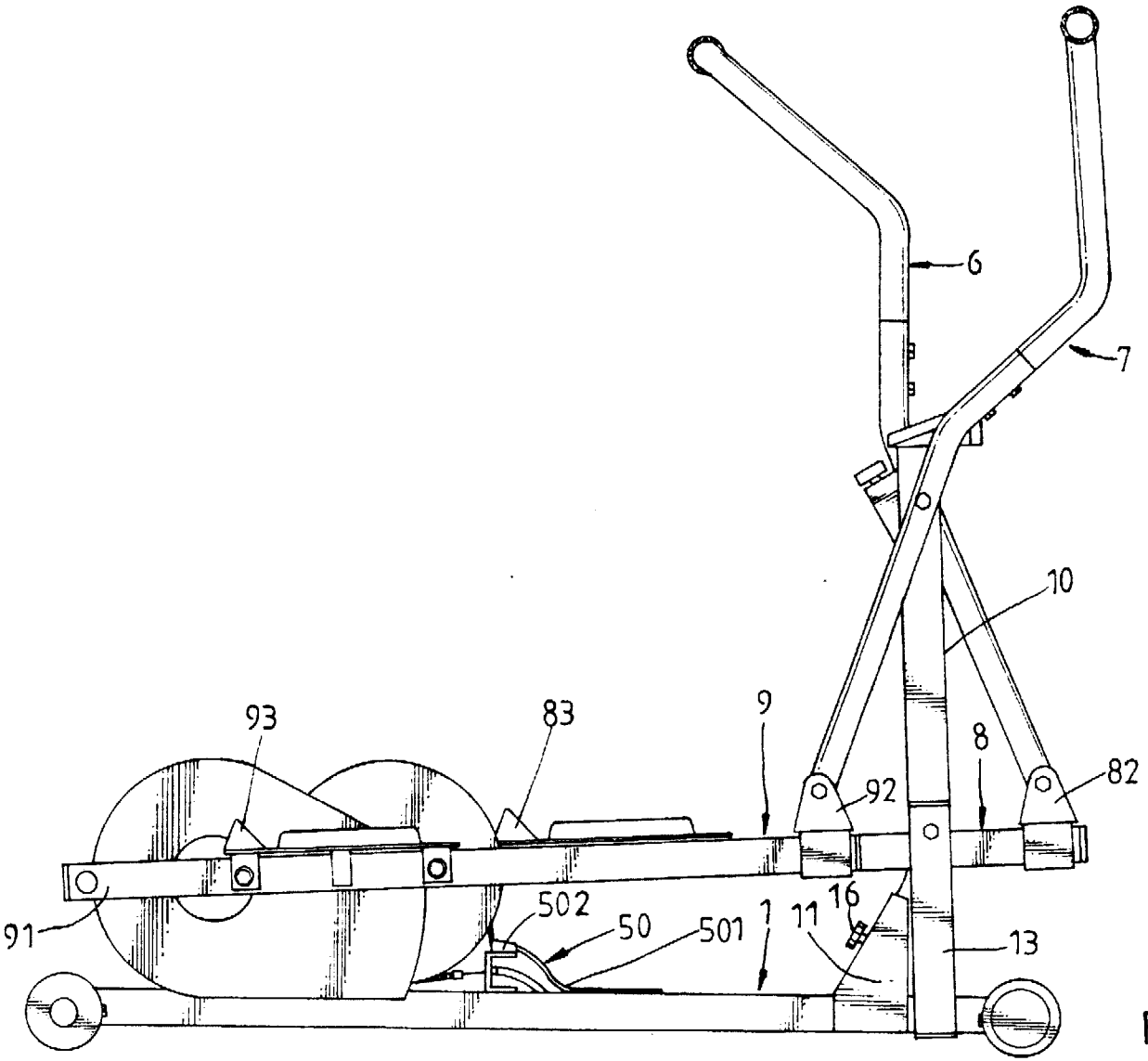
FIG. 6 is another side view of the folding collapsible step exerciser when operated.

When in use, the handlebars 6;7 are grasped with the hands and alternatively pushed and pulled, and the legs are alternatively stepped on the foot plates 83;93. When pedaling the pedals 8;9 the driving wheel 3 is rotated to turn damping wheel 5, and the friction belt 501 imparts a friction resistance to the damping wheel 5 against the driving power from the user's legs (see FIGS. 5 and 6).

Figure 2:
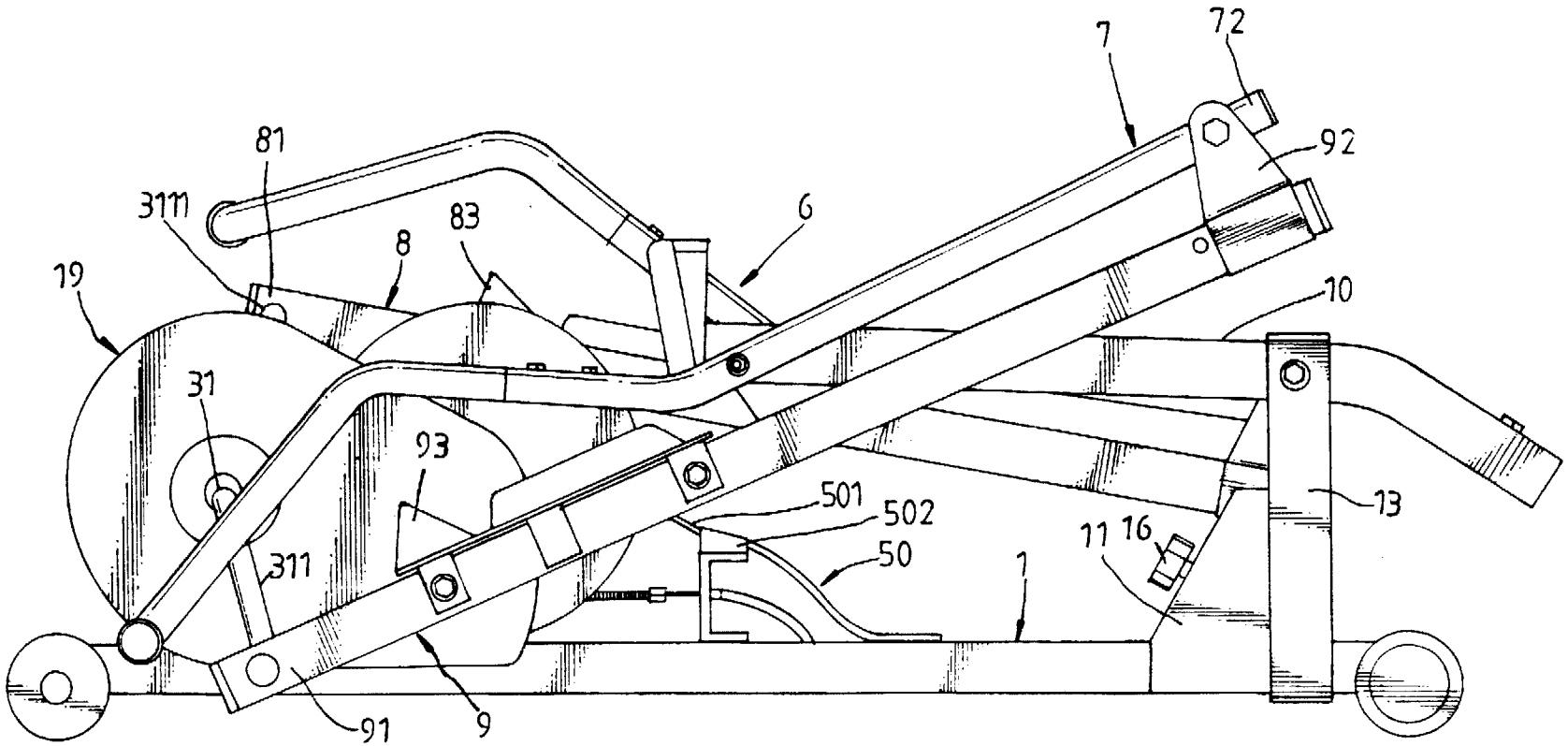
FIG. 2 shows the folding collapsible step exerciser collapsed according to the present invention.

When not in use, the lock screw 16 is disconnected from the front upright 10, permitting the front upright 10 and the handlebars 6;7 to be folded up and closely attached to the base frame 1 to minimize space occupation (see FIG. 2).

Further, a guard frame 19 is mounted on the base frame 1 and covered over the driving wheel 3 and the damping wheel 5 for protection.

I claim:

1. A folding collapsible step exerciser comprising:

a base frame having a front mounting block, two front supports bilaterally and fixedly fastened to said front mounting block, a rear support, and an axle housing transversely and fixedly mounted on a top end of said rear support;

a front upright pivotably connected between said front supports of said base frame by pivot means, having a bottom end releasably secured to said front mounting block of said base frame by a lock screw and a top end fixedly mounted with two horizontally aligned pivots;

a U-shaped damping wheel holder frame fixedly mounted on said base frame between said front supports and said rear support, having two upright arms;

a driving wheel revolvably supported on said axle housing of said base frame, having a fixed wheel shaft made in the form of a double crank;

a damping wheel revolvably supported on said upright arms of said U-shaped damping wheel holder frame, having a coupling portion at one side coupled to said driving wheel;

a transmission belt coupled between said driving wheel and the coupling portion of said damping wheel for permitting said damping wheel to be turned with said driving wheel;

a damping device, said damping device comprising a friction belt mounted on said base frame over the periphery of said damping wheel and imparting a friction resistance to said damping wheel, and an adjustment device controlled to adjust the tension of said friction belt;

an idle wheel pivoted to one upright arm of said U-shaped damping wheel holder frame, and imparting a pressure to said transmission belt to keep it stretched;

two pedals driven to turn said driving wheel, having a respective rear end respectively pivoted to two opposite ends of said fixed wheel shaft of said driving wheel, a respective front end fixedly mounted with a respective U-frame, and a respective foot plate disposed at a top side adjacent the respective rear end; and two handlebars respectively turned about the pivots of said front upright, and a respective bottom end respectively pivoted to the U-frames of said pedals.

* * * * *